US006448876B1

(12) United States Patent
Malingowski et al.

(10) Patent No.: US 6,448,876 B1
(45) Date of Patent: Sep. 10, 2002

(54) LOAD TERMINAL WITH CONDUCTIVE TANG FOR USE IN A CIRCUIT BREAKER

(75) Inventors: Richard Paul Malingowski, Finleyville; William George Eberts, Moon Township, both of PA (US); Jacob Andrew Hjemvick, Asheville, NC (US); Mark Anthony Janusek, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/757,131

(22) Filed: Jan. 9, 2001

(51) Int. Cl.[7] ..... H01H 83/00
(52) U.S. Cl. ..... 335/35; 335/43
(58) Field of Search ..... 335/23–25, 35–38, 335/43–48, 162–176; 337/360–363; 439/810–814

(56) References Cited

U.S. PATENT DOCUMENTS 6,181,226 B1 * 1/2001 Leone et al. ..... 335/35

FOREIGN PATENT DOCUMENTS

JP 5-342970 * 12/1993

* cited by examiner

*Primary Examiner*—Lincoln Donovan
(74) *Attorney, Agent, or Firm*—Martin J. Moran

(57) ABSTRACT

A load conductor for use with a circuit breaker includes a load terminal and a conductive tang engaged with one another. The load terminal is manufactured out of a first material having a first electrical conductivity, and the tang is manufactured out of a second material having a second electrical conductivity. The first electrical conductivity of the first material is such that the load terminal remains at a desirably high temperature during operation of the circuit breaker to avoid interference with the function of a bimetallic strip mounted on the load terminal. The tang extends across a bend formed in the load terminal to avoid the bend from becoming undesirably hot during operation of the circuit breaker. The tang also provides additional conductive cross-section and a higher conductivity surface to reduce the temperature of the load terminal in the vicinity of the clamped joint between the load terminal and the load. The abstract shall not be used for interpreting the scope of the claims.

20 Claims, 4 Drawing Sheets

LOAD TERMINAL WITH CONDUCTIVE TANG FOR USE IN A CIRCUIT BREAKER

BACKGROUND OF THE INVENTION

1. Field of the Invention

The present invention relates generally to circuit breakers and, more particularly, to a load conductor of a circuit breaker. Specifically, the invention relates to a load conductor employing a load terminal and a conductive tang connected therewith, the tang enhancing the electrical conductivity of the load terminal.

2. Description of the Related Art

Numerous types of circuit breakers are known and understood in the relevant art. Among the purposes for which circuit breakers are provided is to interrupt electrical current on command or under certain defined circumstances. Generally stated, most circuit breakers include a line conductor connected with a power source and a load conductor connected with an electrical load, and further include a current interruption system interposed between the line conductor and the load conductor to interrupt current as needed. The current interruption system typically includes an operating mechanism that separates a set of separable electrical contacts to interrupt current from flowing therethrough, and further includes a trip unit operatively connected with the operating mechanism. The trip unit triggers the operating mechanism to separate the electrical contacts during the specified overcurrent, under-voltage, or other condition. In multi-phase circuit breakers, the operating mechanism typically includes a crossbar that simultaneously separates several sets of separable contacts to simultaneously interrupt current through all of the phases of the circuit breaker.

The trip unit typically includes one or more types of tripping mechanisms that are each able to trigger the operating mechanism to interrupt the current under specified conditions. One type of trip mechanism is a thermal trip that includes a bimetallic strip employing at least two layers of metal having different coefficients of thermal conductivity, with the bimetallic strip deflecting and triggering the operating mechanism under certain overcurrent conditions that last for a certain duration of time. Such bimetallic strips rely upon heat generated due to the electrical resistance of the bimetallic strip and of other components of the circuit breaker to the current flowing through the circuit breaker during operation thereof. Other types of tripping mechanisms include magnetic trip mechanisms, blow-open trip mechanisms, and manual trip mechanisms, as well as other trip mechanisms.

Further regarding thermal trip mechanisms, depending upon the configuration of the bimetallic strip and of the circuit breaker as a whole, it typically is desirable to avoid contacting the bimetallic strip with other conductors that are at relatively low temperatures in order to avoid the heat generated within the bimetallic strip from being shunted away to the relatively lower temperature component. In this regard, it has thus been known to manufacture out of stainless steel or other such material a load terminal to which the bimetallic strip is mounted. The stainless steel generates a given amount of heat during operation of the circuit breaker, thus maintaining the load terminal at a relatively high temperature and likewise resisting the shunting of heat from within the bimetallic strip to the load terminal.

Due to size limitations of some circuit breakers, it may also be desirable to augment the heat generated by electrical resistance within the metallic strip with heat that is generated by electrical resistance within other components of the circuit breaker that are in thermally conductive engagement with the bimetallic strip, such as the load terminal. In such applications the load terminal is specifically configured to conduct heat due to electrical resistance therein to the bimetallic strip.

The use of such relatively resistive load terminals has not, however, been without limitation. Depending upon the configuration of the circuit breaker, many load terminals are formed with a right angle bend in order to permit the electrical load to be connected with the load terminal. The bend in such a load terminal often has a tendency to become unduly hot during operation of the circuit breaker.

It has also been observed that clamped joints (such as the clamped joint between the load terminal and the load) become unduly hot during operation of the circuit breaker due to imperfections in the contacting surfaces of the components being clamped and for other reasons. During high fault conditions, therefore, portions of the load terminal that are adjacent such clamped joints can become fused to the load or may result in loss of the material of the load terminal or other undesirable circumstances. Nevertheless, it is still desired to maintain the load terminal at a certain elevated temperature during operation of the circuit breaker to avoid interference with the function of the bimetallic strip by failing to conduct heat thereto or by shunting heat therefrom.

It is thus desired to provide an improved load conductor for a circuit breaker that generates a desirable amount of heat due to electrical resistance during operation of the circuit breaker, yet that is generally not susceptible of fusing or other failure during high fault conditions of operation.

SUMMARY OF THE INVENTION

In view of the foregoing, a load conductor for use with a circuit breaker includes a load terminal and a conductive tang electrically engaged with one another. The load terminal is manufactured out of a first material having a first electrical conductivity, and the tang is manufactured out of a second material having a second electrical conductivity. The first electrical conductivity of the first material is such that the load terminal remains at a desirably high temperature during operation of the circuit breaker to avoid interference with the function of a bimetallic strip mounted on the load terminal. The tang extends across a bend formed in the load terminal to avoid the bend from becoming undesirably hot during operation of the circuit breaker. The tang also provides additional conductive cross-section and a higher conductivity surface to reduce the temperature of the load terminal in the vicinity of the clamped joint between the load terminal and the load.

An objective of the present invention is to provide a load conductor for a circuit breaker in which a load terminal of the load conductor maintains a desirably high temperature during operation of the circuit breaker.

Another objective of the present invention is to provide a load conductor for a circuit breaker in which a bend formed in a load terminal of the load conductor does not become undesirably hot during operation of the circuit breaker.

Another objective of the present invention is to provide a load conductor for a circuit breaker in which the load conductor is advantageously configured to avoid interference with the operation of a bimetallic strip mounted on the load conductor.

Another objective of the present invention is to provide a load conductor for a circuit breaker in which the load conductor is advantageously configured to reduce the temperatures of the load conductor at the clamped joint between the load conductor and the load.

Another objective of the present invention is to provide a circuit breaker having a load conductor that does not interfere with the function of a thermal trip mechanism of the circuit breaker, with the load conductor being substantially immune to fusing with the load during high fault conditions.

An aspect of the present invention is thus to provide a tang for conductive engagement with a load terminal of a circuit breaker, in which the load terminal is made out of a first material having a first electrical conductivity, and in which the load terminal includes an extension portion and a connection portion and is formed with a bend interposed between the extension and connection portions, with the circuit breaker including a thermal trip mechanism connected with the load terminal, and the load terminal being structured to conduct heat due to electrical resistance to the thermal trip mechanism during operation of the circuit breaker, in which the general nature of the tang can be stated as including a first member and a second member connected with one another. The first and second members are each substantially planar and are non-parallel with one another, with the first and second members being formed of a second material having a second electrical conductivity. The first member is structured to be electrically conductively engaged with the extension portion of the load terminal, and the second member is structured to be electrically conductively engaged with the connection portion of the load terminal.

The second electrical conductivity may be greater than the first electrical conductivity.

The extension and connection portions of the load terminal may be oriented at a given angle with respect to one another, with the first and second members being oriented with respect to one another at the given angle.

Another aspect of the present invention is to provide a load conductor for use with a circuit breaker, in which the circuit breaker includes a thermal trip mechanism that is structured to be connected with the load conductor, with the load conductor being structured to conduct heat due to electrical resistance to the thermal trip mechanism during operation of the circuit breaker, in which the general nature of the load conductor can be stated as including a load terminal and a tang. The load terminal includes an extension portion and a connection portion and is formed with a bend interposed between the extension and connection portions. The tang includes a first member and a second member connected with one another. The first member is electrically conductively engaged with the extension portion, and the second member is electrically conductively engaged with the connection portion. The tang extends less than fully along the extension portion of the load terminal.

Still another aspect of the present invention is to provide a circuit breaker, the general nature of which can be stated as including a line conductor, a load conductor, and a thermal trip mechanism connected with the load conductor, the load conductor including a load terminal and a tang. The load terminal includes an extension portion and a connection portion and is formed with a bend interposed between the extension and connection portions. The tang includes a first member and a second member connected with one another, with the first member being electrically conductively engaged with the extension portion, and with the second member being electrically conductively engaged with the connection portion. The load terminal is structured to conduct heat due to electrical resistance to the thermal trip mechanism during operation of the circuit breaker.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENT

Figure 1:
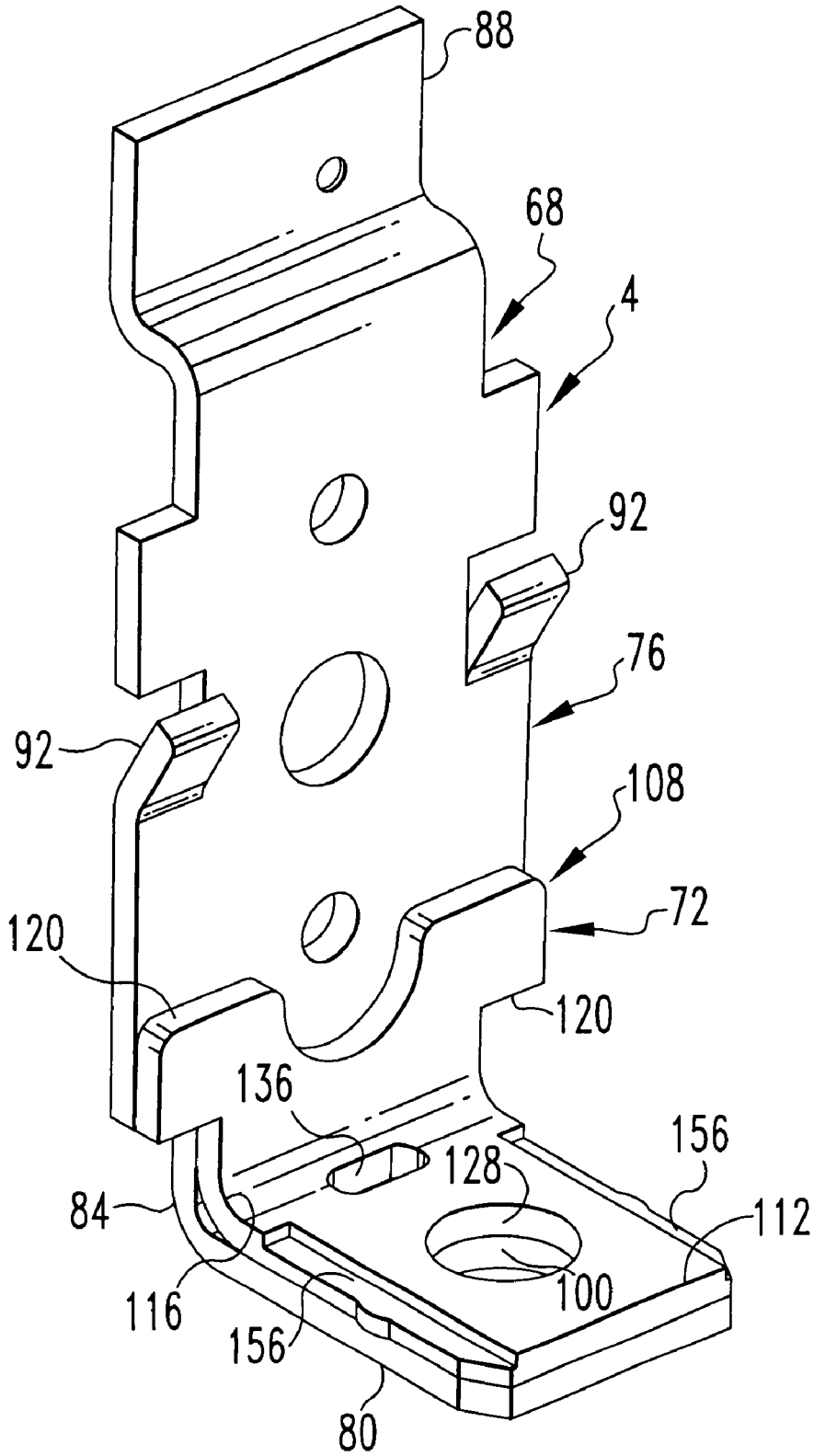
FIG. 1 is a perspective view of a load conductor in accordance with the present invention.

A load conductor 4 in accordance with the present invention is indicated generally in FIGS. 1–4. The load conductor 4 can be employed in a circuit breaker 8 of the type indicated generally in FIG. 2, although the load conductor 4 can be employed in other types of circuit breakers without departing from the concept of the present invention.

Broadly stated, the circuit breaker 8 includes a case 10 in which the load conductor 4 is mounted, with the case 10 additionally carrying a line conductor 12 and a current interruption system 16 operatively interposed between the line conductor 12 and the load conductor 4. Again broadly stated, the current interruption system 16 includes a cradle 20 formed with a ledge 24 against which a latch 28 is disposed during operation of the circuit breaker 8, whereupon removal of the latch 28 from the ledge 24 results in release of the cradle 20. Release of the cradle 20 causes the pivoting of a movable arm 32 which pivots a movable contact 36 that is disposed thereon out of electrical engagement with a stationary contact 40 mounted on the line conductor 12.

Among other types of trip mechanisms, the circuit breaker 8 includes a thermal trip mechanism having a bimetallic member 44. As is known in the relevant art, the bimetallic member 44 includes at least two layers of materials, at least one of which is conductive, having different coefficients of thermal expansion such that the bimetallic member 44 deflects in response to heating from the conduction of current therethrough in a known fashion. The bimetallic member 44 is electrically connected with the movable arm 32 by a flexible conductor 48 extending therebetween. The bimetallic member 44 includes a fixed end 52 that is mounted on the load conductor 4 and further includes an adjustable protrusion 56 extending outwardly from the bimetallic member 44 near a free end 60 that is opposite the fixed end 52. During an overcurrent condition of sufficient duration, the bimetallic member 44 deflects in the aforementioned known fashion to operatively engage the protrusion 56 with an actuation member 64 upon which the latch 28 is mounted. Upon sufficient deflection of the bimetallic member 44, the actuation member 64 is moved sufficiently to disengage the latch 28 from the ledge 24 and trigger the cradle 20 to trip the circuit breaker 8 and interrupt current therethrough.

In order to avoid interfering with the desirable deflection of the bimetallic member 44, the load conductor 4 advantageously includes a load terminal 68 and a conductive tang 72 engaged with one another. The load terminal 68 is manufactured out of a first material having a first electrical conductivity. The tang 72 is manufactured out of a second material having a second electrical conductivity. The first and second materials, as well as the first and second electrical conductivities, are different, although in other configurations the first and second materials and/or the first and second electrical conductivities may be the same without departing from the concept of the present invention. Moreover, while in the embodiment of the load conductor 4 depicted herein the first material is stainless steel and the second material is copper, it is likewise understood that other materials may be employed for either or both of the first and second materials without departing from the concept of the present invention.

Figure 2:
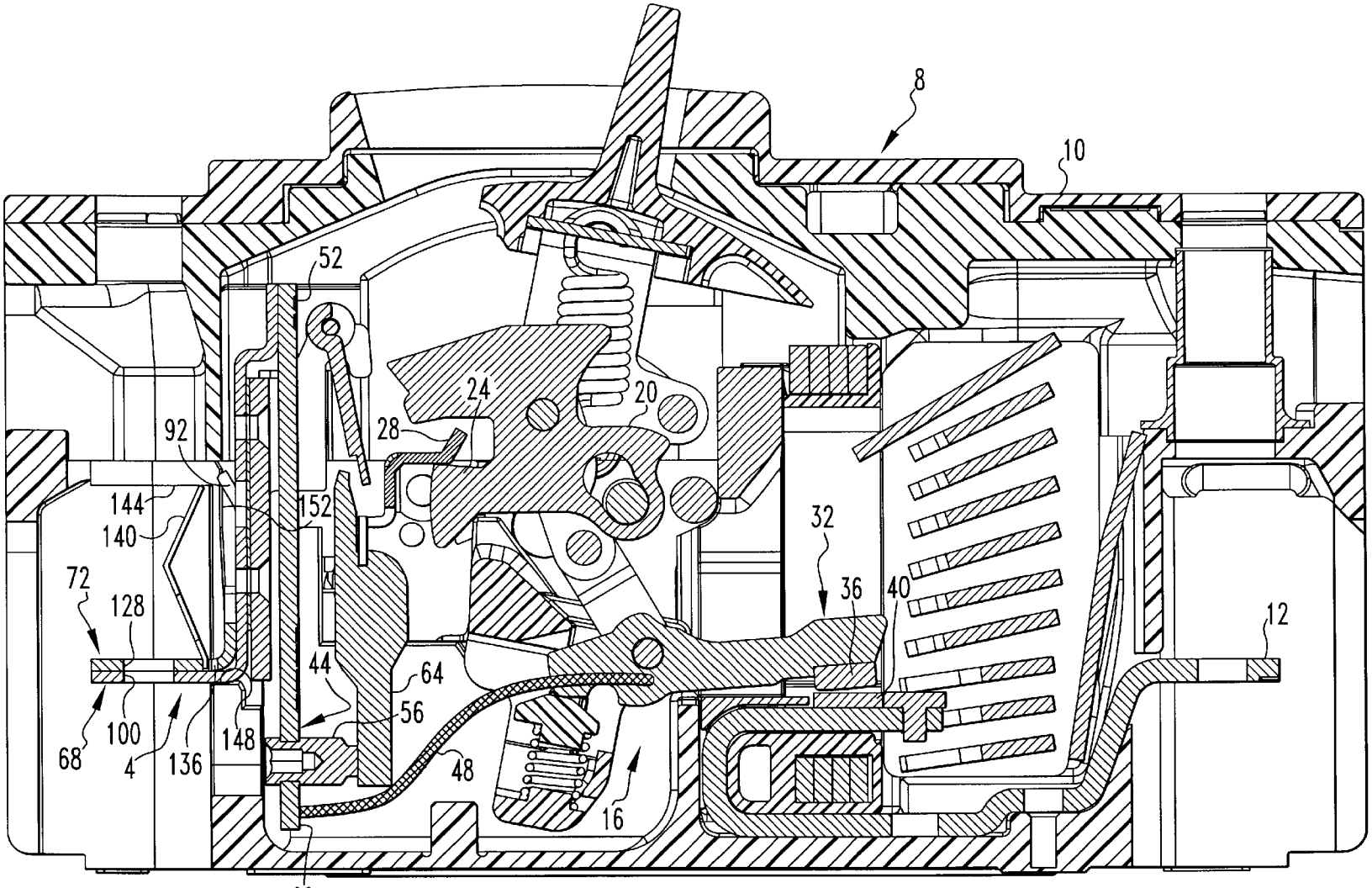
FIG. 2 is a cut away side view of a circuit breaker that incorporates the load conductor of the present invention.

The load terminal 68 includes an extension portion 76 and a connection portion 80 that are connected with one another via a bend 84 formed in the load terminal 68, with the load terminal 68 additionally including a connection plate 88 that is substantially parallel with but offset from the extension portion 76. As is best shown in FIG. 2, the fixed end 52 of the bimetallic member 44 is mounted on and is both electrically and thermally conductively connected with the connection plate 88 of the load terminal 68.

The extension portion 76 includes a pair of arms 92 that protrude outwardly at an angle therefrom for purposes to be set forth more fully below. The extension portion 76 additionally includes a generally planar first mounting surface 96.

The connection portion 80 is formed with a terminal connector hole 100 that is substantially circular in cross section and additionally includes a substantially planar second mounting surface 104. The first and second mounting surfaces 96 and 104 are depicted as being substantially perpendicular to one another, although in other configurations the first and second mounting surfaces 96 and 104 may be oriented at other angles with respect to one another without departing from the concept of the present invention.

The tang 72 includes a first member 108 and a second member 112 that are connected with one another via a transition section 116. While the transition section 116 is depicted herein as being a right angle bend, it is understood that in other embodiments the transition section 116 may be of other configuration without departing from the concept of the present invention.

The first member 108 is configured with a pair of ears 120 that extend outwardly therefrom in opposite directions in order to correspond with the shape of the extension portion 76. The ears 120 may be absent from other configurations of the tang 72 without departing from the concept of the present invention. The first member 108 additionally includes a substantially planar first connection surface 124 (FIG. 4) formed thereon.

Figure 4:
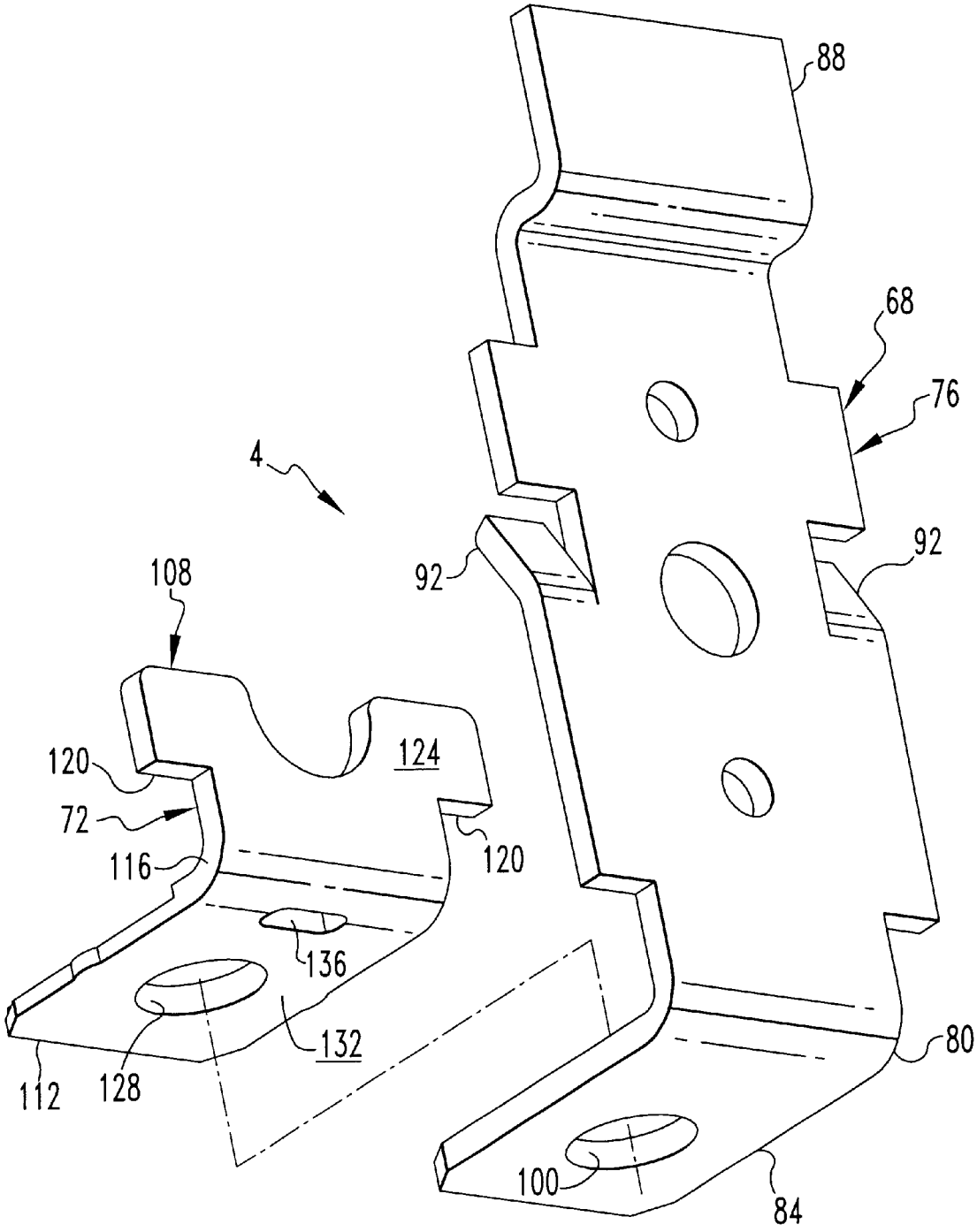
FIG. 4 is a view similar to FIG. 3, except showing the exploded load conductor of the present invention from a different angle.

The second member 112 is formed with a tang connector hole 128 extending therethrough that is of a substantially circular cross section. The second member 112 additionally includes a substantially planar second connection surface 132 (FIG. 4).

It can also be seen that the tang 72 is formed with an elongated retention hole 136 disposed approximately at the point of connection between the second member 112 and the transition section 116. The retention hole 136 extends substantially through the tang 72 and is configured to receive a tab of a retention clip 140 (FIG. 2) that retains the load conductor 4 in a desired position on the case 10. More specifically, the retention clip 140 is an angled member extending between an overhanging surface 144 formed on the case 10 and the tang 72 to engage the load conductor 4 against an abutment surface 148 formed on the case 10. While the retention clip 140 retains the load conductor 4 on the case 10 in the position depicted generally in FIG. 2, it is understood that the load conductor 4 can be retained in the position depicted in FIG. 2 by other means without departing from the concept of the present invention.

As is best shown in FIG. 2, a portion of the load conductor 4 extends through a slot 152 formed in the case 10. Specifically, the extension portion 76 of the load terminal 68 and the first member 108 of the tang 72 extend through the slot 152. In this regard the slot 152 is sized to receive therein both the extension portion 76 and the first member 108, although it can be seen that the first member 108 extends along only a portion of the extension portion 76. The arms 92 are thus provided to be disposed against one of the walls of the slot 152 to retain the extension portion 76 therein with minimal slippage. While a separate shim may be employed within the slot 152 in the place of the arms 92 to retain the extension portion 76 therein with minimal slack, the arms 92 advantageously perform the retention function without the need for an additional part for such purpose.

As is best shown in FIGS. 1 and 2, the load terminal 68 and the tang 72 are engaged against one another to form the load conductor 4 of the circuit breaker 8. In this regard, the first connection surface 124 is received against the first mounting surface 96, and the second connection surface 132 is received against the second mounting surface 104. As such, the first member 108 is conductively engaged with the extension portion 76, and the second member 112 is conductively engaged with the connection portion 80.

The load terminal 68 and the tang 72 are depicted in FIGS. 1–4 as being connected with one another in such a fashion that current can freely flow therebetween. The load terminal 68 and the tang 72 are fastened to one another with a bond (not shown in FIG. 1 for purposes of clarity) formed between the load terminal 68 and the tang 72 by known methods such as brazing, soldering, and other types of bonding. Alternatively, or in addition thereto, a fastener may extend between the load terminal 68 and the tang 72. Such an appropriate fastener would include a rivet, a screw, a pin, or any other type of appropriate fastener. Other structures and/or methods may be employed to fasten the load terminal 68 and the tang 72 with one another without departing from the concept of the present invention. Moreover, the load terminal 68 and tang 72 may be conductively connected with one another but unfastened with one another depending upon the specific needs of the particular application, By electrically conductively engaging the tang 72 with the load terminal 68 on opposite sides of the bend 84, the tang 72 provides an additional conductor by which current can flow from the extension portion 76 to the connection portion 80 without having to flow through the bend 84, thus reducing the temperature of the bend 84. The tang 72 also functions as a shunt which conducts or shunts current from the extension portion 76 directly to the load (not shown.) If the tang 72 is made of a material having a higher electrical conductivity than that of the load terminal 68, the tang provides a more highly conductive surface for the clamp joint with the load than if the load were connected directly to the load terminal 68. The temperature of the load conductor 4 is thus reduced at the clamp joint, which reduces the likelihood of the load conductor 4 fusing with the load or loss of the material of the load conductor. Additionally, the tang 72 is thermally conductively engaged with the load terminal 68 whereby the tang 72 can conduct heat away from the load conductor 68 on opposite sides of the bend 84.

As such, the conductive engagement of the tang 72 with the load terminal 68 reduces the operating temperature of the bend 84 and of the clamp joint with the load below what they would ordinarily be in the absence of the tang 72. The reduction in the temperature of the bend 84 and at the clamp joint likewise advantageously reduces the temperature of the connection portion 80 and lessens the likelihood of loss of the material of the connection portion 80 during high fault conditions.

Figure 3:
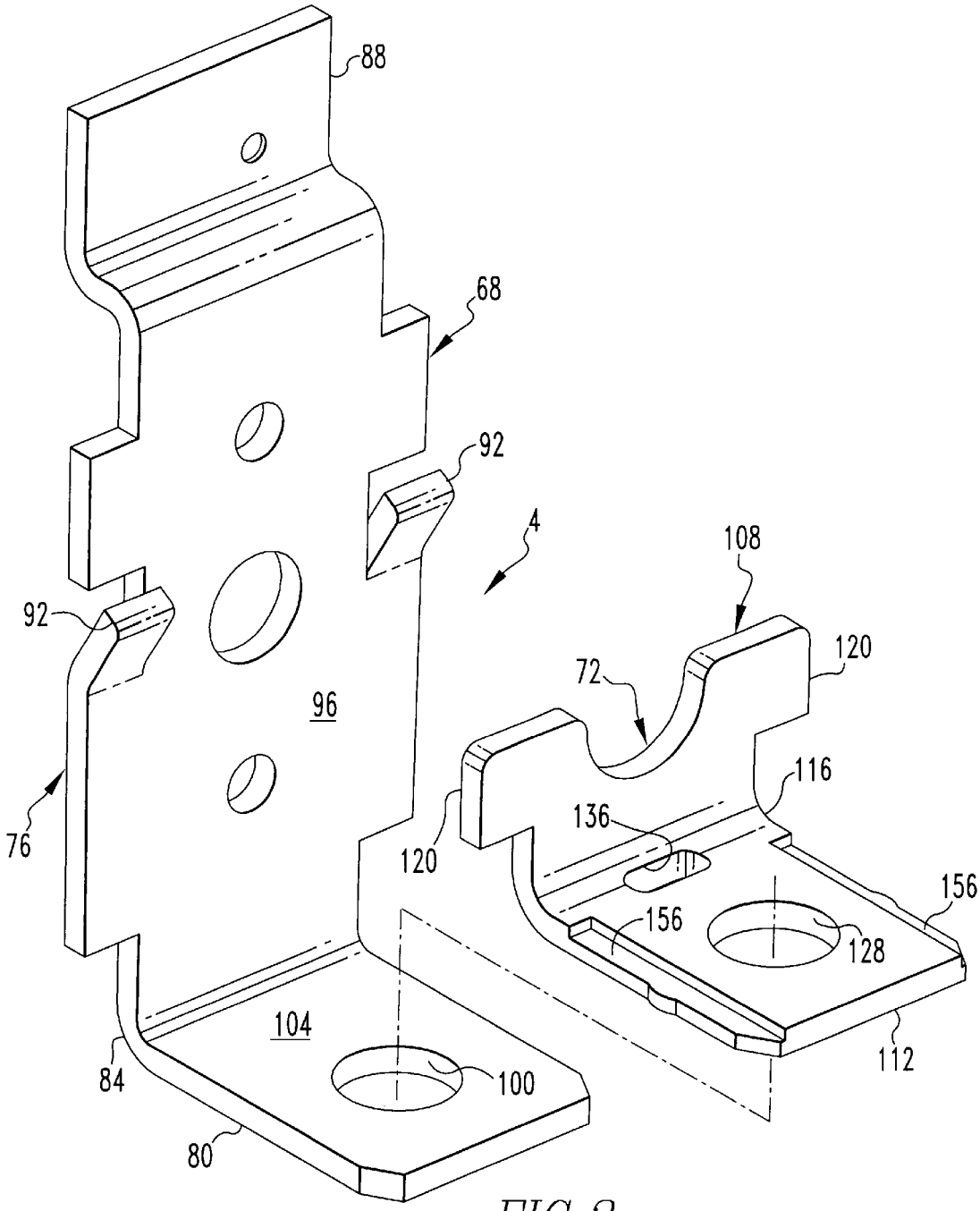
FIG. 3 is a view similar to FIG. 1, except showing the load conductor of the present invention exploded.

As is depicted in FIGS. 1, 3, and 4, the second member 112 is depicted as including a pair of small shelves 156 formed on opposite sides thereof. The shelves 156 facilitate the use of certain types of collars (not shown) for connecting the load with the load conductor 4. In other embodiments (not shown) the second member 112 may be formed without the shelves 156 or may be formed with other structures without departing from the concept of the present invention.

In use, the terminal connector hole 100 and tang connector hole 128 are axially aligned, and the conductor (not shown) that extends to the load (not shown) is electrically engaged with the outer surface of the second member 112 that is opposite the second connection surface 132. In this regard, an appropriate collar or other connector may be employed to more securely engage the conductor with the second member 112. Such collars typically include a threaded screw (not shown) or other such device that can extend through the combined opening formed by the terminal connector hole 100 and the tang connector hole 128 to securely engage the conductor that is connected with the load to the second member 112. In this regard, the tang 72 further advantageously resists the load terminal 68 from becoming fused with the conductor connected with the load by interposing the second member 112 between the load terminal 68 and the conductor.

Despite the temperature reduction in the bend 84 that is achieved by engaging the tang 72 with the load terminal 68 as indicated above, the portion of the load terminal 68 that is not engaged against the tang 72 remains substantially at the temperature at which it would operate in the absence of the tang 72. In this regard, it can be seen from FIGS. 1–4 that the tang 72 advantageously extends less than fully along the load terminal 68. More specifically, the first member 108 extends only along a portion of the extension portion 76. It can thus be seen that the tang 72 enhances the electrical conductivity of the load terminal 68 along the areas of contact therewith, but does not enhance the electrical conductivity in other areas of the load terminal 68. As such, the tang 72 does not meaningfully reduce the temperature of the connection plate 88 to which the bimetallic member 44 is mounted and thus does not interfere with the function of the bimetallic member 44 by causing heat to be drawn away from it and into the load conductor 4. Moreover, if the circuit breaker 8 is configured such that heat is to be conducted from the load terminal 68 into the bimetallic member 44, the tang 72 can be accordingly configured to itself avoid drawing heat away from the extension portion 76. As such, the tang 72 advantageously avoids interference with the function of the bimetallic member 44 by not reducing the temperature of the load terminal 68 in such a way that the load terminal 68 might fail to conduct appropriate heat to the bimetallic member 44 during operation of the circuit breaker 4.

The tang 72, when combined with the load terminal 68, thus advantageously forms the load conductor 4 that can be used in the circuit breaker 8. The tang 72 reduces the temperature of the bend 84 of the load terminal 68 and that of the clamp joint with the load and does not interfere with the function of the bimetallic member 44, either by undesirably shunting heat away from the bimetallic member 44 or by undesirably failing to conduct heat to the bimetallic member 44, depending upon the configuration of the circuit breaker 8. As such, while the tang 72 is depicted as extending substantially along the full extent of the connection portion 80 but extending only along a portion of the extension portion 76, it is understood that in other embodiments of the load conductor 4 the tang 72 may be of other configurations that extend to a greater or lesser extent along the extension portion 76 or the connection portion 80 without departing from the concept of the present invention.

While a particular embodiment of the present invention has been described herein, it is understood that various changes, additions, modifications, and adaptations may be made without departing from the scope of the present invention, as set forth in the following claims.

What is claimed is:

1. A tang for conductive engagement with a load terminal of a circuit breaker, the load terminal being made out of a first material having a first electrical conductivity, the load terminal including an extension portion and a connection portion and being formed with a bend interposed between the extension and connection portions, the circuit breaker including a thermal trip mechanism connected with the load terminal, the load terminal being structured to conduct heat due to electrical resistance to the thermal trip mechanism during operation of the circuit breaker, the tang comprising:

a first member and a second member connected with one another, the first and second members each being substantially planar and being non-parallel with one another, the first and second members being formed of a second material having a second electrical conductivity, the first member being structured to be electrically conductively engaged with the extension portion of the load terminal, and the second member being structured to bye electrically conductively engaged with the connection portion of the load terminal, an intermediate tang region existing between said first member and said second member, said intermediate tang region not being electrically conductively engaged with said bend.

2. The tang as set forth in claim 1, in which the second electrical conductivity is greater than the first electrical conductivity.

3. The tang as set forth in claim 1, in which the extension and connection portions of the load terminal are oriented at a given angle with respect to one another, and in which the first and second members are oriented with respect to one another at the given angle.

4. The tang as set forth in claim 1, in which the second material is copper.

5. A load conductor for use with a circuit breaker, the circuit breaker including a thermal trip mechanism structured to be connected with the load conductor, the load conductor being structured to conduct heat due to electrical resistance to the thermal trip mechanism during operation of the circuit breaker, the load conductor comprising:

a load terminal including an extension portion and a connection portion and being formed with a bend interposed between the extension and connection portions; and a tang including a first member and a second member connected with one another, the first member being electrically conductively engaged with the extension portion, and the second member being electrically conductively engaged with the connection portion, an intermediate tang region existing between said first member and said second member, said intermediate tang region not being electrically conductively engaged with said bend.

6. The load conductor as set forth in claim 5, in which the load terminal is made out of a first material having a first electrical conductivity, and in which the tang is made out of a second material having a second electrical conductivity, the second electrical conductivity being greater than the first electrical conductivity.

7. The load conductor as set forth in claim 5, in which the extension portion is formed with a substantially planar first mounting surface and the connection portion is formed with a substantially planar second mounting surface, and in which the first member is formed with a substantially planar first connection surface and the second member is formed with a substantially planar second connection surface, the first mounting surface being electrically conductively disposed against the first connection surface, and the second mounting surface being electrically conductively disposed against the second connection surface.

8. The load conductor as set forth in claim 7, in which the first and second mounting surfaces are non-parallel with one another.

9. The load conductor as set forth in claim 5, in which the tang and the load terminal are fastened with one another.

10. The load conductor as set forth in claim 5, in which the first material is stainless steel and in which the second material is copper.

11. The load conductor as set forth in claim 5, in which the tang extends less than fully along the extension portion of the load terminal.

12. A circuit breaker comprising:

a line conductor;

a load conductor; and a thermal trip mechanism connected with the load conductor;

the load conductor including a load terminal and a tang;

the load terminal including an extension portion and a connection portion and being formed with a bend interposed between the extension and connection portions;

the tang including a first member and a second member connected with one another, the first member being electrically conductively engaged with the extension portion, and the second member being electrically conductively engaged with the connection portion, an intermediate tang region existing between said first member and said second member, said intermediate tang region not being electrically conductively engaged with said bend; and the load terminal being structured to conduct heat due to electrical resistance to the thermal trip mechanism during operation of the circuit breaker.

13. The circuit breaker as set forth in claim 12, in which the load terminal is made out of a first material having a first electrical conductivity, and in which the tang is made out of a second material having a second electrical conductivity, the second electrical conductivity being greater than the first electrical conductivity.

14. The circuit breaker as set forth in claim 12, in which the extension portion is formed with a substantially planar first mounting surface and the connection portion is formed with a substantially planar second mounting surface, and in which the first member is formed with a substantially planar first connection surface and the second member is formed with a substantially planar second connection surface, the first mounting surface being electrically conductively disposed against the first connection surface, and the second mounting surface being electrically conductively disposed against the second connection surface.

15. The circuit breaker as set forth in claim 14, in which the first and second mounting surfaces are non-parallel with one another.

16. The circuit breaker as set forth in claim 12, in which the first material is stainless steel and in which the second material is copper.

17. The circuit breaker as set forth in claim 12, in which the tang and the load terminal are fastened to one another with one of a bond and a fastener.

18. The circuit breaker as set forth in claim 12, in which the thermal trip mechanism includes a bimetallic member.

19. The circuit breaker as set forth in claim 12, in which the load terminal is formed with a terminal connector hole, and the tang is formed with a tang connector hole, the terminal connector hole and the tang connector hole being axially aligned with one another.

20. The circuit breaker as set forth in claim 12, in which the tang extends less than fully along the extension portion of the load terminal.

* * * * *